US005879181A

United States Patent [19]

Okabe

[11] Patent Number: 5,879,181

[45] Date of Patent: Mar. 9, 1999

[54] INSULATION PIERCING TERMINAL

[75] Inventor: Toshiaki Okabe, Shizuoka, Japan

[73] Assignee: Yazaki Corporation, Tokyo, Japan

[21] Appl. No.: 906,900

[22] Filed: Aug. 6, 1997

[30] Foreign Application Priority Data

Aug. 6, 1996 [JP] Japan ..... 8-207209

[51] Int. Cl.[6] ..... H01R 4/24

[52] U.S. Cl. ..... 439/397; 439/399

[58] Field of Search ..... 439/397, 398, 439/399, 400, 406, 407

[56] References Cited

U.S. PATENT DOCUMENTS 4,385,794 5/1983 Lucius ..... 439/399

*Primary Examiner*—Neil Abrams
*Assistant Examiner*—Antoine Ngandjui
*Attorney, Agent, or Firm*—Sughrue, Mion, Zinn, Macpeak & Seas, PLLC

[57] ABSTRACT

An insulation piercing terminal is so designed that, by press working a piece of metal plate, an electrical contact section which is engaged with a mating terminal, and a wire clamping section are formed respectively at the front end portion and at the rear end portion, and an insulation piercing conductive section is formed between those sections, the insulation piercing conductive section being U-shaped in section, having right and left side walls, and a bottom wall, and the right and left side walls of the insulation piercing conductive section are partially cut and bent inwardly to form a pair of right and left insulation piercing blades which defines an insulation piercing slot. In the insulation piercing terminal, the bottom wall of the insulation piercing conductive section is a curved bottom wall which is curved downwardly in such a manner that the bottom wall is smoothly continuous to the right and left side walls, and the curved bottom wall has stability supports so that the curved bottom wall is stably set on a flat surface.

7 Claims, 3 Drawing Sheets

INSULATION PIERCING TERMINAL

BACKGROUND OF THE INVENTION

This invention relates to an insulation piercing terminal which is so designed that, when a covered wire is pushed in an insulation piercing slot, the conductor (core) of the wire is brought into contact with the insulation piercing terminal without removal of the insulating cover of the wire.

FIGS. 3(*a*) to 3(*c*) show a conventional insulation piercing terminal disclosed by U.S. Pat. No. 4,385,794. More specifically, FIG. 3(*a*) is a perspective view of the insulation piercing terminal, FIG. 3(*b*) is a sectional view taken along line IIIb—IIIb, and FIG. 3(*c*) is a perspective view showing part of a covered wire connected to the insulation piercing terminal.

In the figures, an insulation piercing terminal 1 is formed by blanking and press working a piece of thin metal sheet. Its front end portion is an electrical contact section 2 which is engaged with a mating terminal, and its rear end portion is a wire clamping section 3, and the middle portion between those front and rear end portions is an insulation piercing conductive portion 4. The electrical contact portion 2 is engaged with the mating terminal so that the former is electrically connected with the latter; the wire clamping section 3 has right and left retaining pieces (parts of the walls) 3*a*, which are bent inwardly to fixedly hold the wire W from above the insulating cover Wb; and the insulation piercing conductive section 4 is electrically connected to the conductor Wa of the wire W. The wire clamping section 3 is coupled through a first neck 6 to the insulation piercing conductive section 4, and the insulation piercing conductive section 4 is coupled through a second neck 7 to the electrical contact section 2.

The insulation piercing conductive section 4 has a front insulation piercing piece 10A and a rear insulation piercing piece 10B respectively at the front end and at the rear end. Each of the front and rear insulation piercing pieces 10A and 10B has a pair of right and left insulation piercing blades which are confronted with each other, forming an insulation piercing slot 12 in which the conductor of the wire is pushed. The wire clamping section 3, the insulation piercing conductive section 4, and the electrical contact section 2 have a bottom wall 7 formed of a belt-shaped common flat plate.

The insulation piercing conductive section 4 is U-shaped in section, having a part of the bottom wall 7, and a pair of right and left side walls 9 which are formed by bending the right and left edge portions of the bottom wall 7 upwardly. In this case, the right and left edge portions of the bottom wall are bent 90° upwardly so that the resultant right and left side walls are confronted with each other, and suitable recesses 18 are formed on the bending lines by pressing, thereby to increase the rigidity of the portions corresponding to the bending lines. The insulation piercing blades 11 of the insulation piercing pieces 10A and 10B are formed by inwardly bending the front and rear edge portion of the side walls 9.

The wire W is connected to the insulation piercing terminal 1 as follows; One end portion of the wire W is laid on the rear end portion of the insulation piercing terminal 1 in such a manner that the one end portion of the wire W is in parallel with the rear end portion of the insulation piercing terminal 1. Under this condition, the one end portion of the wire W is pushed in the insulation piercing slots 12 of the insulation piercing conductive section 4 from above. In this case, the right and left insulation piercing blades 11 cut the insulating cover Wb of the wire W and contact the conductor Wa of the wire W. When the one end portion of the wire W is further pushed in, the conductor Wa is caused to go in between the right and left insulation piercing blades 11, thus being positively held by the insulation piercing blades 11. In this operation, force is applied to open the right and left insulation piercing blades 11 outwardly.

In general, an insulation piercing terminal is mass-produced, and a number of insulation piercing terminals are built in a connector housing in such a manner that they are adjacent to one another. Hence, there has been a strong demand for the provision of an insulation piercing terminal which is small in size, and light in weight. In order to decrease the weight of the insulation piercing terminal, it is essential to reduce the thickness of a metal plate which is formed into the insulation piercing terminal. And in order to miniaturize the insulation piercing terminal, it is necessary to decrease the width and the length of the insulation piercing terminal. For instance, in order to decrease the width of the insulation piercing terminal, it is essential to decrease the width of the insulation piercing blades forming the insulation piercing slot.

However, if the thickness of the metal plate, which is used to form the insulation piercing terminal, is decreased, or if the width of the insulation piercing blades is decreased, then the mechanical strength of the insulation piercing blades is decreased, as a result of which, when the wire is pushed in the insulation piercing slot, the right and left insulation piercing blades are opened outwardly.

In view of the foregoing, in the conventional insulation piercing terminal 1 shown in FIGS. 3 (*a*) to 3(*c*), the insulation piercing blades 11 are formed by bending inwardly the front and rear edge portions of the side walls 9 of the insulation piercing conductive section 4. However, the force which acts on the insulation piercing blades 11 when the wire is pushed in the insulation piercing slots, acts collectively on the junctions (the bent portions) of the side walls 9 and the bottom wall 7 (the junctions being decreased in thickness in the above-described bending operation; i.e., reduced in mechanical strength). As a result, the side walls 9 are apt to be bent outwardly, and accordingly, the insulation piercing blades 11 may be bent outwardly (opened). In order to overcome this difficulty, the recesses 18 are formed on the junctions of the side walls 9 and the bottom wall 7; however, the recesses 18 are not so effective in preventing the upper end portions of the side walls 9 from falling aside; that is, they are not so effective in preventing the insulation piercing blades 11 from being opened.

SUMMARY OF THE INVENTION

Accordingly, an object of the invention is to eliminate the above-described difficulties accompanying a conventional insulation piercing terminal.

More specifically, an object of the invention is to provide an insulation piercing terminal which is miniaturized, and in which, when the wire is pushed in between the insulation piercing blades, the insulation piercing blades are prevented from being opened outwardly; that is, to improve the reliability in electrical connection of the insulation piercing terminal.

In order to achieve the foregoing object of the invention, according to a first aspect of the invention, an insulation piercing terminal is so designed that, by press working a piece of metal plate, an electrical contact section which is engaged with a mating terminal, and an insulation piercing conductive section are formed respectively at the front end portion and at the rear end portion, and the insulation piercing conductive section is U-shaped in section, having right and left side walls, and a bottom wall, and the right and left side walls of the insulation piercing conductive section are partially cut and bent inwardly to form right and left insulation piercing blades which defines an insulation piercing slot; in which the bottom wall of the insulation piercing conductive section is a curved bottom wall which is curved downwardly in such a manner that the bottom wall is smoothly continuous to the right and left side walls, and the curved bottom wall has stability supports so that the curved bottom wall is stably set on a flat surface.

In this insulation piercing terminal, no bent portions are provided between the bottom wall and the right and left side walls of the insulation piercing conductive section. This feature decreases the concentration of stress in the insulation piercing terminal, and prevents the right and left side walls from falling aside. Hence, when the wire is pushed in the insulation piercing slots of the insulation piercing conductive section, the right and left insulation piercing blades are prevented from being opened outwardly. When the insulation piercing terminal is placed on a flat plate, the stability supports formed on the curve bottom wall stably set the insulation piercing terminal stably.

According to a second aspect of the invention, in the insulation piercing terminal of the first aspect, the stability supports are small protrusions formed on the junctions of the curved bottom wall and the right and left side walls by pressing.

In this insulation piercing terminal, small protrusions are formed, as stability supports, on the junctions of the curved bottom wall and the right and left side walls by pressing. Those small protrusions reinforce the junctions of the curved bottom wall and the right and left side walls.

According to a third aspect of the invention, in the insulation piercing terminal of the first or second aspect, a wire clamping section is disposed at the rear end of the insulation piercing conductive section, the wire clamping section has a bottom wall and right and left side walls which are bent inwardly to clamp a wire through an insulating cover, the bottom wall of the wire clamping section is an prolongation of the curved bottom wall of the insulation piercing conductive section, and the right side walls of the wire clamping section and the insulation piercing conductive section are provided as one continuous side wall, while the left side walls of the wire clamping section and the insulation piercing conductive section are provided as one continuous side wall.

In this insulation piercing terminal, the side walls of the insulation piercing conductive section are continuous to those of the wire clamping section, and therefore the side walls of the insulation piercing conductive section are restricted in movement by those of the wire clamping section. When the wire is pushed in the insulation piercing slots of the insulation piercing conductive section, the right and left insulation piercing blades tend to open outwardly; however, the insulation piercing blades are scarcely opened outwardly because, as was described above, the side walls of the insulation piercing conductive section are restricted in movement by the side walls of the wire clamping section. In the case where clamping the wire and pushing the wire in the insulation piercing slots are carried out at the same time, the side walls of the wire clamping section are bent inwardly when the wire is clamped. Hence, even if the insulation piercing blades of the insulation piercing conductive section tend to open outwardly as the wire is pushed, the insulation piercing blades are prevented from being opened outwardly because the inward force acting on the side walls of the wire clamping section and the outward force acting on the side walls of the insulation piercing conductive section through the insulation piercing blades are canceled by each other.

According to a fourth aspect of the invention, in the insulation piercing terminal of the third aspect, the stability supports are provided on the curved bottom wall of the wire clamping section.

In this insulation piercing terminal, the stability supports are provided on the curved bottom wall of the wire clamping section as was described above. Hence, the wire clamping section can be set stably.

According to a fifth aspect of the invention, in the insulation piercing terminal of any one of the first to fourth aspects, the insulation piercing conductive section has front and rear insulation piercing pieces respectively at the front end and at the rear end each of which has the right and left insulation piercing blades and the insulation piercing slot between them, and the insulation piercing blades of the front and rear insulation piercing pieces are formed by bending protrusions inwardly which are extended from the front and rear edges of the right and left sides walls of the insulation piercing conductive section.

In this insulation piercing terminal, the insulation piercing conductive section has the front and rear insulation piercing pieces respectively at the front end and at the rear end. Therefore, the distance between the insulation piercing pieces is relatively long.

According to a sixth aspect of the invention, in the insulation piercing terminal of any one of the first to fourth aspects, the right and left side walls of the insulation piercing conductive section have first openings, respectively, and protrusions extended from the front and rear edges of the first openings are bent inwardly to form the insulation piercing blades.

In this insulation piercing terminal, the right and left side walls of the insulation piercing conductive section have the first openings, respectively, and the protrusion extended from the front and rear edges of the first openings are bent inwardly to form the insulation piercing blades, Therefore, the peripheral portions of the side walls remain each like a frame.

According to a seventh aspect of the invention, in the insulation piercing terminal of the sixth aspect, the right and left side walls of the insulation piercing conductive section have second openings in such a manner that the second openings are in alignment with the first openings in a front-to-rear direction thereof , and protrusion extended from the front or rear edge of the second openings are bent inwardly to form the insulation piercing blades.

In this insulation piercing terminal, because of the formation of the first and second openings in the side walls, at least three insulation piercing pieces are arranged in the front-to-rear direction of the insulation piercing terminal, and all the insulation piercing pieces are continuous to one another through the side walls. This feature prevents the insulation piercing blades of the insulation piercing pieces from being opened outwardly.

DETAILED DESCRIPTION OF THE INVENTION

Preferred embodiments of the invention will be described with reference to the accompanying drawings.

Figure 1A:
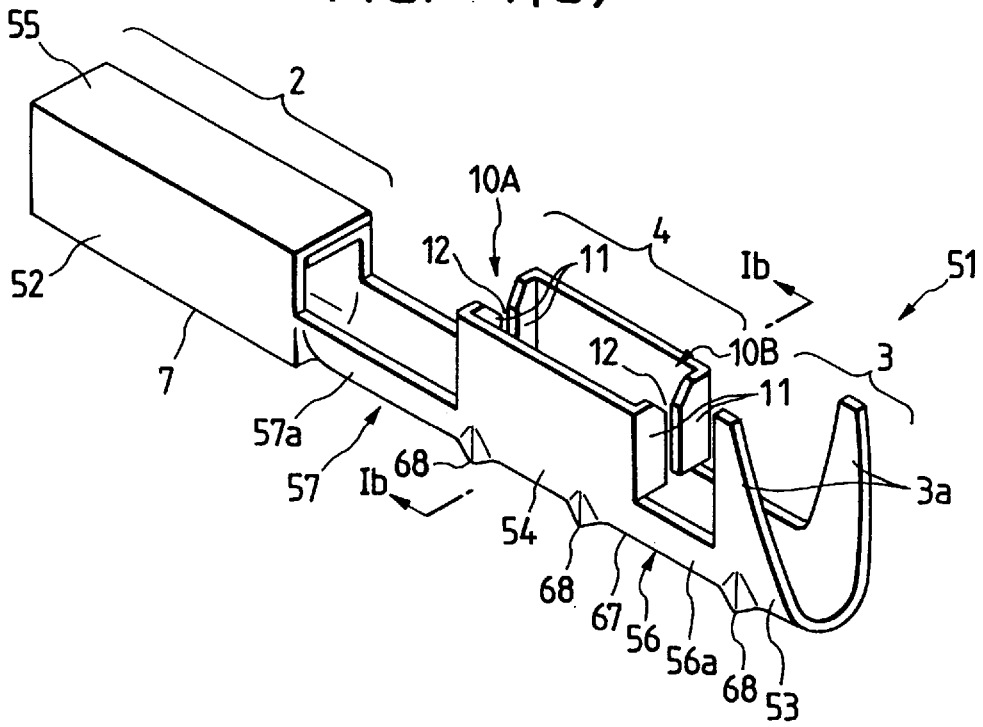
FIG. 1(*a*) is a perspective view of an example of an insulation piercing terminal, which constitutes a first embodiment of the invention, and FIG. 1(*b*) is a sectional view showing a portion taken along line Ib—Ib in FIG. 1(*a*) together with a wire.

FIGS. 1(*a*) and 1(*b*) show an example of an insulation piercing terminal, which constitutes a first embodiment of the invention. In the drawings, reference numeral 51 designates the insulation piercing terminal of the invention. The insulation piercing terminal 51 is obtained by blanking and press working a piece of thin metal plate. The front end portion of the insulation piercing terminal 51 is an electrical contact section 2 which is engaged with a mating terminal, and the rear end portion is a wire clamping section 3, and the middle portion between the front and rear end portions is an insulation piercing conductive section 4.

The electrical contact section 2 is engaged with the mating terminal to electrically connect the mating terminal to the insulation piercing terminal, and accordingly the wire W to the mating terminal. The electrical contact section 2 is in the form of a box, having right and left side walls 52, a top wall 55, and a bottom wall 7. The wire clamping section 3 is to hold the wire W through the insulating cover Wb. The wire clamping section 3 is U-shaped in section, having a part of a curved bottom wall 67 which is curved downwardly in section, and right and left side walls 53. The upper end portions of the right and left side walls 53 are retaining pieces 3*a* which are bent inwardly over the wire W thereby to hold the wire W through the insulating cover Wb. The insulation piercing conductive section 4 is to electrically connect the terminal to the conductor Wa of the wire W, and it is U-shaped in section, having a part of the curved bottom wall 67, and right and left side walls 54.

The wire clamping section 3 is coupled to the insulation piercing conductive section 4 through a first coupling section 56 which is U-shaped in section, having a part of the curved bottom wall 67, and right and left side walls 56*a*. The insulation piercing conductive section 4 is coupled to the electrical contact section 2 through a second coupling section 57 which is U-shaped in section, having a part of the curved bottom wall 67, and right and left side walls 57*a*.

The curved bottom wall 67, extended from the wire clamping section 3 up to the electrical contact section 2, is one common bottom wall which is arcuate in section. The right side walls 53, 56*a*, 54, 57*a* and 52 of the electrical contact section 2, the insulation piercing conductive section 4, and the wire clamping section 3 are provided as one continuous side wall, and the left side walls 53, 56*a*, 54, 57*a* and 52 of those sections 2, 3 and 4 are also provided as one continuous side wall. Those side walls 53, 56*a*, 54, 57*a* and 52 are formed by smoothly upwardly extending the side walls which are extended from the right and left edges of the curved bottom wall 67. The side walls 56*a* and 57*a* of the coupling sections 56 and 57 are obtained by slightly upwardly extending the right and left edges of the curved bottom wall 67.

The insulation piercing conductive section 4 has front and rear insulation piercing pieces 10A and 10B respectively at the front end and at the rear end. Each of the insulation piercing pieces 10A and 10B has a pair of right and left insulation piercing blades 11 which are confronted with each other, thus defining an insulation piercing slot 12 between them in which the conductor of a wire is pushed. The insulation piercing blades 11 are formed by bending the protrusions inwardly which are extended from the front and rear ends of the right and left side walls.

Figure 1B:
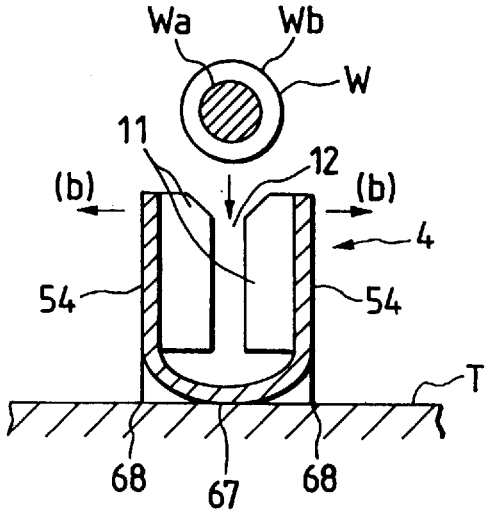

In order to stably set the curved bottom wall 67 on a flat surface T, the junctions of the curved bottom wall 67 and the right and left side walls 54 and 53 of the insulation piercing conductive section 4 and the wire clamping section 3, as shown in FIG. 1(b), have small protrusions (or stability supports) 68 which are formed as indents by pressing. More specifically, a plurality of small protrusions 67 are arranged at intervals in the longitudinal direction of the insulation piercing terminal.

Now, the function of the insulation piercing terminal thus formed will be described.

A wire W is connected to the insulation piercing terminal 51 as follows: The insulation piercing terminal is placed on the flat plate T. Although the bottom surface of the insulation piercing terminal is curved, the junctions of the curved bottom wall 67 and the right and left side walls 54 and 53 have the small protrusions 68 as stability supports. Therefore, the insulation piercing terminal 51 is set stable on the flat plate T.

Under this condition, one end portion of the wire is laid over the rear end portion of the insulation piercing terminal 51 in such a manner that the one end portion is in parallel with the rear end portion of the insulation piercing terminal 51. Thereafter, the one end portion of the wire W is pushed in the insulation piercing slots 12 of the insulation piercing conductive section 4 from above. In this operation, the right and left insulation piercing blades cut the insulating cover Wb of the wire W, and contact the conductor Wa of the wire W. When the wire is further pushed in, the conductor Wa is caused to go in between the right and left insulation piercing blades 11, and positively held by the blades 11.

Figure 3A:
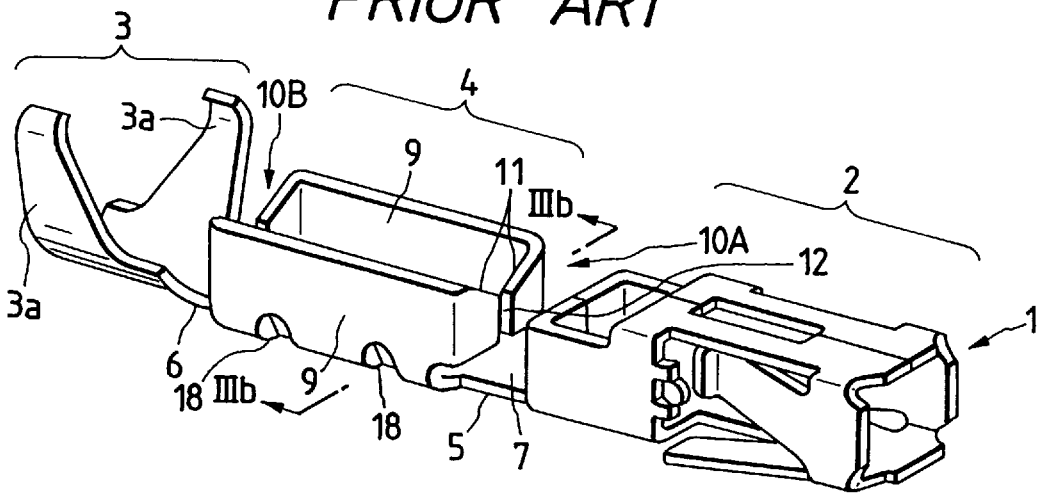
FIG. 3(a) PRIOR ART
FIGS. 3(*a*) is a perspective view of a conventional insulation piercing terminal, FIG. 3(*b*) is a sectional view taken along line IIIb—IIIb in FIG. 3(*a*), and FIG. 3(*c*) is a perspective view showing part of the conventional insulation piercing terminal to which a wire is connected.
Figure 3B:
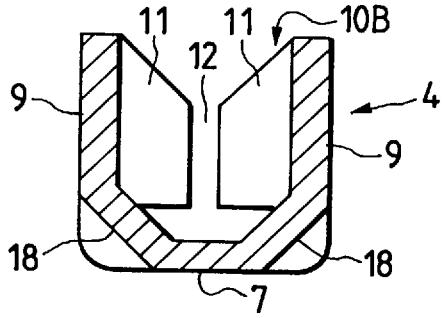
FIG. 3(b) PRIOR ART
Figure 3C:
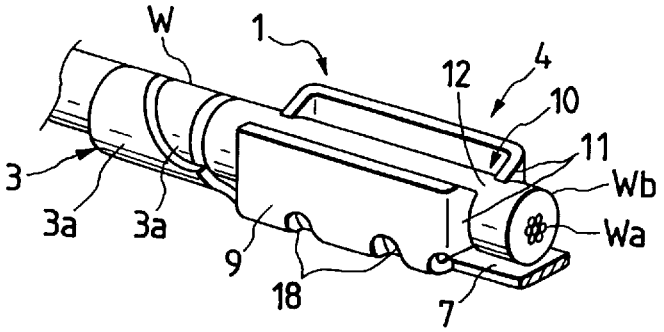
FIG. 3(c) PRIOR ART

In this operation, force is applied to open the right and left insulation piercing blades 11 outwardly in the direction of the arrows (b) in FIG. 1(*b*); however, the insulation piercing blades 11 are prevented from opening outwardly for the following reason:

The insulation piercing terminal 51, unlike the conventional one shown in FIG. 3, has no bent portion between the bottom wall 67 of the insulation piercing conductive section 4 and the right and left side walls 54. This feature decreases the concentration of stress, and substantially prevents the right and left walls from falling aside. Hence, when the wire W is pushed in the insulation piercing slots 12 of the insulation piercing conductive section 4, the right and left insulation piercing blades 11 are prevented from opening outwardly. The part of the insulation piercing terminal, from the curved bottom wall 67 up to the right and left side walls 54, has the small protrusions 68 as stability supports. Those small protrusions 68 reinforce the part of the insulation piercing terminal, which is from the curved bottom wall 67 up to the right and left side wall 54, which more effectively prevents the side walls 54 from falling aside.

Furthermore, in the insulation piercing terminal 51, the side walls 52, 54 and 53 of the electrical contact section 2, the insulation piercing conductive section 4 and the wire clamping section 3 are continuous to one another through the side walls 56*a* and 57*a* of the second and first coupling sections 56 and 57. Hence, the insulation piercing terminal 51 is increased in rigidity as a whole, and the side walls 54 of the insulation piercing conductive section 4 are greatly restricted in motion by the side walls 52 and 54 of the electrical contact section 2 and the wire clamping section 3 which are located before and after the insulation piercing conductive section 4. Especially, since the electrical contact section 2 is in the form of a box, a force of restriction by the side walls 52 of the electrical contact section 2 is considerably great. As a result, even when force is applied to open the insulation piercing blades 11 of the insulation piercing conductive section 4 outwardly, the side walls 54 forming the insulation piercing blades 11 are restricted at the front and rear end; that is, the insulation piercing blades 11 will not be opened outwardly.

The clamping (holding) of the wire W with the wire clamping section 3, and the pushing of the wire W into the insulation piercing conductive section 4 may be carried out at the same time. In this case, the retaining pieces 3*a* of the upper end portions of the side walls 53 of the wire clamping section 3 are bent inwardly. Hence, even if the insulation piercing blades 11 of the insulation piercing conductive section 4 are caused to open outwardly as the wire is pushed in, the inward force acting on the side walls 53 of the wire clamping section 3 and the outward force acting on the side walls 54 through the insulation piercing blades 11 of the insulation piercing conductive section 4 are canceled out by each other. As a result, the insulation piercing blades 11 are more positively prevented from being opened outwardly.

As was described above, the right and left insulation piercing blades are prevented from being opened. Therefore, when the width of the insulation piercing blades 11 is decreased to miniaturize the insulation piercing terminal, the insulation piercing terminal is free from the difficulty that, when the wire is pushed in the insulation piercing slots, the insulation piercing blades 11 cut the insulating cover Wb unsatisfactorily. In addition, the contact load (or holding load) on the conductor Wa of the wire W can be high enough; that is, the electrical connection is improved in reliability.

In the part of the insulation piercing terminal, from the wire clamping section 3 up to the insulation piercing conductive section 4, the right and left side walls 53 and 54 and the curved bottom wall 67 which are all arcuate in section are continuously extended as one unit. This feature prevents the centers of the insulation piercing conductive section 4 and the wire clamping section 3 from shifting from each other, and eliminates the difficulty that, when the wire W is pushed in the insulation piercing slots or clamped, the wire W is bent, which lowers the work efficiency. The wire clamping section 3 has the small protrusions 68 as stability supports, too. Hence, the wire clamping section 3 can be held stable, which facilitates the wire clamping operation. Furthermore, the insulation piercing pieces 10A and 10B are provided at the front and rear ends of the insulation piercing conductive section 4. That is, the distance between the front and rear insulation piercing pieces 10A and 10B is relatively long, which facilitates the terminal and wire assembling work.

Figure 2:
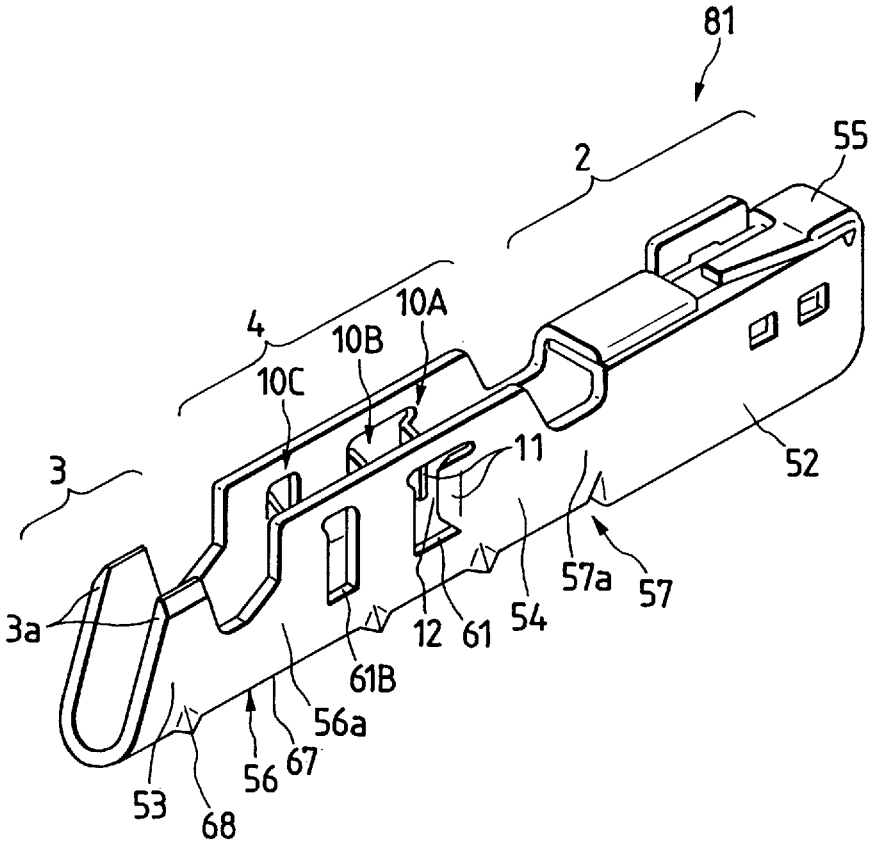
FIG. 2 is a perspective view of another example of the insulation piercing terminal, which constitutes a second embodiment of the invention.

Now, another example of the insulation piercing terminal, which constitutes a second embodiment of the invention, will be described with reference to FIG. 2. In FIG. 2, reference numeral 81 designates the aforementioned insulation piercing terminal of the second embodiment of the invention.

The insulation piercing terminal 81, like the insulation piercing terminal 51 (the first embodiment), is obtained by blanking and press working a piece of thin metal plate. The front end portion of the insulation piercing terminal 81 is an electrical contact section 2 which is engaged with the mating terminal, the rear end portion of the insulation piercing terminal 81 is a wire clamping section 3, and the portion between those two sections 2 and 3 is an insulation piercing conductive section 4. The wire clamping section 3 is coupled to the insulation piercing conductive section 4 through a first coupling section 56, and the insulation piercing conductive section 4 is coupled to the electrical contact section 2 through a second coupling section 57. In FIG. 2, parts corresponding functionally to those already described with reference to FIG. 1 (the first embodiment) are designated by the same reference numerals or characters.

The insulation piercing terminal 81 is different from the insulation piercing terminal 51 of the first embodiment in the structure of the insulation piercing conductive section 4. In the insulation piercing terminal 81, first rectangular openings 61 are formed in the right and left side walls 54 of the insulation piercing conductive section 4, and second rectangular openings 61B, which are smaller than the first openings, are formed in the same side walls in such a manner that they are located behind the first openings 61. Protrusions extended from the front and rear edges of the first openings 61 are bent inwardly to form the insulation piercing blades 11 of first and second insulation piercing pieces 10A and 10B, and insulation piercing slots 12 formed between them. The protrusions extended from the rear edges of the second rectangular openings 61B are bent inwardly to form the insulation piercing blades of a third insulation piercing piece 10C, and an insulation piercing slot between them.

In this case, the openings 61 and 61B are rectangular, that is, the peripheral portions of the side walls 54 remain each like a frame. Hence, the side walls 54 are not so greatly decreased in mechanical strength, and the resultant insulation piercing blades are positively prevented from being opened outwardly. No insulation piercing blades are provided at the front and rear ends of the side walls 54, and therefore the front and rear ends of the side walls 54 can be made continuous to the side walls 52 of the front electrical contact section 2 and the side walls 53 of the rear wire clamping section 3. This feature increases the mechanical strength of the side walls of the insulation piercing conductive section 4 with ease. Since the first and second openings 61 and 61B form the first, second and third insulation piercing pieces 10A, 10B and 10C, the wire insulation piercing strength can be increased, and the electrical connection is improved in reliability.

In the above-described embodiment, the second opening 61B is located behind the first opening 61; however, the invention is not limited thereto or thereby; that is, the second opening 61B may be located before the first opening 61. Furthermore, the insulation piercing piece may be formed at the front edges of the second opening 61B. Moreover, third and fourth insulation piercing pieces may be formed before and behind the second opening 61B. The number of insulation piercing pieces is at least one, and the number of openings should be determined according to the number of insulation piercing pieces.

As described above, in the insulation piercing terminal of the first aspect of the invention, the bottom wall of the insulation piercing conductive section is curved downwardly and made smoothly continuous with the right and left side walls, and therefore no bent portions are provided between the bottom wall and the right and left side walls of the insulation piercing conductive section. This feature decreases the concentration of stress and falling of the right and left side walls, so that it prevents the right and left insulation piercing blades from falling aside when the wire is pushed in the insulation piercing slots of the insulation piercing conductive section. Hence, in the case where the width of the insulation piercing blades is decreased to miniaturize the insulation piercing terminal, the insulation piercing terminal is free from the difficultly that, when the wire is pushed in the insulation piercing slots of the insulation piercing conductive section, the insulation piercing blades unsatisfactorily cut the insulating cover of the wire, and the contact load (or holding load) on the conductor Wa of the wire W can be high enough; that is, the electrical connection is improved in reliability. In placing the insulation piercing terminal on a flat plate, the stability supports formed on the curved bottom wall function to set the insulation piercing terminal stable. Hence, although the curved bottom wall is arcuate in section, the insulation piercing terminal can be correctly set in the connector housing or the like. Furthermore, with the insulation piercing terminal set in the connector housing or the like, the insulation piercing operation can be achieved with high efficiency.

The insulation piercing terminal of the second aspect of the invention has the following effects or merits in addition to those of the insulation piercing terminal of the first aspect. That is, in the insulation piercing terminal of the second aspect, small protrusions are formed, as stability supports, on the junctions of the curved bottom wall and the right and left side walls by pressing. Those small protrusions reinforce the junctions of the curved bottom wall and the right and left side walls. Hence, the side walls are more effectively prevented from falling aside, and accordingly the insulation piercing blades are positively prevented from being opened outwardly.

The insulation piercing terminal of the third aspect has the following effects or merits in addition to those of the insulation piercing terminal of the first or second aspect. That is, in the insulation piercing terminal of the third aspect, the side walls of the insulation piercing conductive section are continuous to those of the wire clamping section, and therefore the side walls of the insulation piercing conductive section are restricted in movement by those of the wire clamping section. When the wire is pushed in the insulation piercing slots of the insulation piercing conductive section, the right and left insulation piercing blades tend to open outwardly; however, the insulation piercing blades are scarcely opened outwardly because, as was described above, the side walls of the insulation piercing conductive section are restricted in movement by those of the wire clamping section. In the case where clamping the wire and pushing the wire in the insulation piercing slots are carried out at the same time, the side walls of the wire clamping section are bent inwardly when the wire is clamped. Hence, even if the insulation piercing blades of the insulation piercing conductive section tend to open outwardly as the wire is pushed, the insulation piercing blades are prevented from being opened outwardly because the inward force acting on the side walls of the wire clamping section and the outward force acting on the side walls of the insulation piercing conductive section through the insulation piercing blades are canceled by each other.

The insulation piercing terminal of the fourth aspect of the invention has the following effects or merits in addition to those of the insulation piercing terminal of the third aspect. That is, in the insulation piercing terminal of claim 4, the stability supports are provided on the curved bottom wall of the wire clamping section as was described above. Hence, the wire clamping section can be stably set, which makes it possible to achieve the wire clamping operation with high efficiency.

The insulation piercing terminal of the fifth aspect of the invention has the following effects or merits in addition to those of the insulation piercing terminal of any one of the first to fourth aspects. That is, in the insulation piercing terminal of the fifth aspect, the insulation piercing conductive section has the front and rear insulation piercing pieces respectively at the front end and at the rear end. Therefore, the distance between the insulation piercing pieces is relatively long, which increases the work efficiency in the insulation piercing terminal manufacturing operation as much.

The insulation piercing terminal of the sixth aspect of the invention has the following effects or merits in addition to those of the insulation piercing terminal of any one of the first to fourth aspects. That is, in the insulation piercing terminal of the sixth aspect, the right and left side walls of the insulation piercing conductive section have the first openings, respectively, and the protrusion extended from the front and rear edges of the first openings are bent inwardly to form the insulation piercing blades. Therefore, the peripheral portions of the side walls remain like frames. Hence, the insulation piercing blades which is substantially prevented from being opened outwardly can be obtained with the side walls maintained substantially unchanged in mechanical strength. Since no insulation piercing blades are provided at the front and rear ends of the side walls, the front and rear ends of the side walls may be made continuous to the side walls of the electrical contact section and to those of the wire clamping section, which increases the mechanical strength of the side walls of the insulation piercing conductive section.

The insulation piercing terminal of the seventh aspect of the invention has the following effects or merits in addition to those of the insulation piercing terminal of the sixth aspect. That is, in the insulation piercing terminal of the seventh aspect, because of the formation of the first and second openings in the side walls, at least three insulation piercing pieces are arranged in the front-to-rear direction of the insulation piercing terminal. This feature increases the insulation piercing strength of the wire, and therefore the electrical connection is high in reliability.

What is claimed is:

1. An insulation piercing terminal comprising:

an electrical contact section which is engaged with a mating terminal; and an insulation piercing conductive section, said electrical contact section and said insulation piercing conductive section being formed respectively by press working a piece of metal plate, said insulation piercing conductive section being U-shaped in section having right and left side walls, and a bottom wall, and the right and left side walls of said insulation piercing conductive section being partially cut and bent inwardly to form right and left insulation piercing blades which defines an insulation piercing slot, wherein said bottom wall of said insulation piercing conductive section is a curved bottom wall which is curved downwardly in such a manner that said bottom wall is smoothly continuous to said right and left side walls, and wherein said curved bottom wall has stability supports so that said curved bottom wall is stably set on a flat surface.

2. The insulation piercing terminal as claimed in claim 1, wherein said stability supports are small protrusions formed on junctions of said curved bottom wall and said right and left side walls by pressing.

3. The insulation piercing terminal as claimed in claim 1, wherein said insulation piercing terminal further comprises a wire clamping section at a rear end of said insulation piercing conductive section; said wire clamping section has a bottom wall and right and left side walls which are bent inwardly to clamp a wire through an insulating cover of the wire; said bottom wall of said wire clamping section is an prolongation of said curved bottom wall of said insulation piercing conductive section; and the right side walls of said wire clamping section and said insulation piercing conductive section are provided as one continuous side wall, while the left side walls of said wire clamping section and said insulation piercing conductive section are provided as one continuous side wall.

4. The insulation piercing terminal as claimed in claim 3, wherein said stability supports are provided on the curved bottom wall of said wire clamping section.

5. The insulation piercing terminal as claimed in claim 1, wherein said insulation piercing conductive section has front and read insulation piercing pieces respectively at a front end and at a rear end of said insulation piercing conductive section, each of said insulation piercing pieces has said right and left insulation piercing blades and said insulation piercing slot defined thereby, and said insulation piercing blades of said front and rear insulation piercing pieces are formed by inwardly bending protrusions which are extended from front and rear edges of said right and left side walls of said insulation piercing conductive section.

6. The insulation piercing terminal as claimed in claim 1, wherein said right and left side walls of said insulation piercing conductive section have first openings, respectively, and protrusions extended from front and rear edges of said first openings are bent inwardly to form said insulation piercing blades.

7. The insulation piercing terminal as claimed in claim 6, wherein said right and left side walls of said insulation piercing conductive section have second openings in such a manner that said second openings are in alignment with said first openings in a front-to-rear direction thereof, and protrusions extended from at least one of front and rear edges of said second openings are bent inwardly to form said insulation piercing blades.

* * * * *